US005941377A

United States Patent [19]

Hart et al.

[11] Patent Number: 5,941,377

[45] Date of Patent: Aug. 24, 1999

[54] BEVERAGE CARRIER WITH SEPARATE PARTITIONS

[75] Inventors: Joseph J. Hart, Philadelphia County, Pa.; Karl A. Kohler, DuPage County, Ill.

[73] Assignee: Jefferson Smurfit Corporation, St. Louis, Mich.

[21] Appl. No.: 08/958,241

[22] Filed: Oct. 27, 1997

[51] Int. Cl.[6] ..... B65D 5/48; B65D 75/00

[52] U.S. Cl. ..... 206/175; 206/198; 229/933

[58] Field of Search ..... 206/170, 174, 206/175, 180, 193, 198; 229/914, 933, 934, 935, 936, 937

[56] References Cited

U.S. PATENT DOCUMENTS

| | | | |
|---|---|---|---|
| Re. 31,176 | 3/1983 | Raubenheimer . | |
| 2,389,318 | 11/1945 | Lebold . | |
| 2,686,003 | 9/1954 | Forrer . | |
| 2,694,504 | 11/1954 | Shanahan . | |
| 2,711,844 | 6/1955 | Buttery et al. . | |
| 2,900,106 | 8/1959 | Vesak . | |
| 2,967,003 | 1/1961 | Forrer et al. . | |
| 3,084,831 | 4/1963 | Arneson . | |
| 3,722,738 | 3/1973 | Wright . | |
| 3,893,565 | 7/1975 | Rossi et al. . | |
| 4,103,818 | 8/1978 | Raubenheimer . | |
| 4,210,241 | 7/1980 | Morcom . | |
| 4,253,564 | 3/1981 | Engdahl, Jr. | 206/198 X |
| 4,358,047 | 11/1982 | Raubenheimer . | |
| 4,493,415 | 1/1985 | Wood | 206/175 |
| 4,919,261 | 4/1990 | Lashyro et al. . | |
| 4,927,009 | 5/1990 | Stout . | |

*Primary Examiner*—Jacob K. Ackun

[57] ABSTRACT

A carrier is provided which is made of a carrier box and a separate partition assembly which is secured in the carrier box. The partition assembly is made from transverse and cross partitions which have interengaging slots and tabs which lock together to form the partition assembly without the use of glue. The carrier box is formed from a simple blank having wall panels and bottom panels. The bottom panels are glued together to form a glued bottom and are shaped so that the outer of the bottom panels meet along a junction that is offset from the center of the carrier bottom. In an alternative, and preferred embodiment, the carrier box is formed from a one piece blank and the partition is formed from a one piece blank. The partition includes a transverse partition or divider and at least one cross-partition or divider. The partition is formed from a blank, which is preferably a one-piece blanks. The blank includes a first body section, a second body section, and a handle forming section. The first and second body sections are hingedly connected to each other at a bottom of the partition and form the transverse divider of the partition. The handle forming section is hingedly connected to the first body section at a top of the first body section. The first and second body portions each include at least one fold-out section to define the at least one cross-divider of the partition. Also shown are two embodiments of the carrier itself which includes locking means for holding the bottom of the carrier in place substantially without the use of glue.

5 Claims, 12 Drawing Sheets

BEVERAGE CARRIER WITH SEPARATE PARTITIONS

BACKGROUND OF THE INVENTION

This invention relates to beverage carriers, and, in particular, to a basket carrier having either a separate partition formed from longitudinal and transverse partitions which interlock with each other to form an unglued, grid-like divider or a separate folded and glued partition which, when placed in its erected condition within a carton, will receive and separate the bottles from contact with each other.

Basket carriers are well known for carrying bottles of soda, beer, etc. Basket carriers are often produced from a single blank. That is, the outer surfaces which form the four walls and the bottom of the carrier and the partition elements are all formed as one blank, which is then folded to be formed into a carrier. The folding of such blanks is complicated and requires complicated machinery to apply the glue in the appropriate areas and to fold the blanks into carriers. Further, because the carrier is made from a single blank, the blanks cannot be easily nested. Thus, there is a significant amount of paperboard that is wasted due to the space between adjacent carrier blanks.

BRIEF SUMMARY OF THE INVENTION

One object of the present invention is to provide a new and improved bottle carrier.

Another object is to provide such a carrier which is easy to assemble.

Another object is to provide such a carrier which is formed from a carrier blank and separate partition blanks.

Another object is to provide a carrier blank which may be nested to reduce waste in the production of the carrier blanks and partitions.

These and other objects will become apparent to those skilled in the art in light of the following disclosure and accompanying drawings.

In accordance with the invention, generally stated, an improved beverage bottle carrier is provided. The bottle carrier comprises a carrier box and a separate partition assembly which is secured in the box to divide the box into a plurality of bottle receiving cells. The box has a front wall, a back wall, side walls, and a bottom. The bottom is made of a plurality of panels which depend from the walls. Two of the panels are inner panels and two of the panels are outer panels. The inner and outer panels are secured to each other to form a glued or locked bottom. The bottom outer panels are sized to meet at a joint without covering each other for the glued bottom. The joint between the bottom outer panels is offset from a center of the carrier box bottom. Preferably, one of the bottom outer panels has a cutout and another of the bottom outer panels has a tab. The cutout out and tab are shaped complementary to each other, and the use of the cutout and tab provides for a non-linear juncture between the outer panels. The use of the glued bottom and the non-linear junction between the bottom outer panels will reduce the chance of the carrier bottom sagging when it is transported with bottles therein because it eliminates the center fold which is commonly provided for in currently available carriers. This is similar when using the locked bottom. The front and back walls of the carrier box have substantially linear upper edges and the side walls could have peaked upper edges.

The partition assembly comprises at least one transverse partition having a length substantially equal to the distance between the carrier box side walls and at least one cross partition having a length substantially equal to the distance between the carrier box front and back walls. Each of the partitions includes glue tabs along side edges of the partitions, at least one slot extending from an edge of the partition and a tab receiving slot above each of the at least one slots. The glue tabs are adhered to inner surfaces of the carrier box to secure the partition assembly in the carrier box. The partition slot has a tab which extends into the slot part way up the slot. The tab has a generally flat edge parallel to the edge from which the slot extends and facing away from an opening into the slot. The partition assembly is formed by sliding the slot of one partition in to the slot of the other partition and then rotating the transverse and cross partitions relative to each other so that the tab of the transverse partition is received in the tab receiving slot of the cross partition and so that the tab of the cross partition is received in the tab receiving slot of the transverse partition. This structure of the partitions allows for the partitions to co-act with each other so that the partitions may be locked together without the use of glue.

One of the transverse partitions is a center transverse partition which extends between the side walls at the center of the side walls, the center transverse partition has a height greater than the height of the carrier box walls. The portion of the center transverse partition which extends above the carrier box walls defines a handle section and has an opening therethrough sized to receive the fingers of a user's hand. The carrier box is formed from a single blank made of wall panels corresponding to the carrier walls; bottom panels used to form the carrier bottom, and a handle panel. The handle panel is separated from the wall and bottom panels by a tear line to be removable from the blank. The handle panel is sized to fit over the handle section of the center transverse partition.

In an alternative, and preferred embodiment, a beverage bottle carrier comprises a carrier box and a separate partition assembly which is secured in said box to divide the box into a plurality of bottle receiving cells. The carrier box has a front wall, a back wall, side walls, and a bottom. The bottom is made of a plurality of panels which depend from the walls. Two of the bottom forming panels are inner panels and two of the bottom forming panels are outer panels. The inner and outer panels are secured to each other to form the bottom of the carrier. The bottom outer panels are sized to meet at a joint which is offset from a center of the carrier box bottom;

The partition includes a transverse partition or divider and at least one cross-partition or divider. The partition is formed from a blank, which is preferably a one-piece blank. The blank includes a first body section, a second body section, and a handle forming section. The first and second body sections are hingedly connected to each other at a bottom of the partition and form the transverse divider of the partition. The handle forming section is hingedly connected to the first body section at a top of the first body section. The first and second body portions each include at least one fold-out section to define the at least one cross-divider of the partition. Preferably, the first and second body portions each include two fold-out sections to form four dividers which will define six bottle cells with the lateral divider.

The first and second body portions of the partition each include a handle section. When the partition is formed, the handle forming portion of the partition blank folded over the handle section of the second body portion. This will form a carrier having a handle of at least three plies. The partition blank can include a second handle forming portion which is hingedly connected to the second body portion. This will form a four-ply handle for the carrier.

Alternate embodiments of the carrier provide for securing the bottom of the carrier in place substantially without the use of glue. The carrier includes a front, a back, sides, and a bottom which cooperate to define an open toped box. The box can include any of the above noted dividers to form a plurality of bottle receiving chambers in the box., the carrier including locking means for maintaining the bottom of the carrier in its desired position without the use of glue. In a first alternative embodiment of the carrier, the carrier bottom includes a single bottom panel hingedly connected to the front panel. The back panel includes a glue tab. The bottom panel extends between the front and back panels and is adhered to the glue tab. In one variation of the first alternative embodiment, one of the sides of the carrier includes a tab at the bottom thereof. A slot is formed in the tab which opens toward the opposing side of the carrier. The slot is sized and shaped to receive the bottom panel of the carrier to hold the carrier bottom in place. In a second variation of this embodiment, both sides of the carrier include such slots. The bottom panel is received in the slots to hold the carrier bottom in place.

In a second alternative embodiment for the carrier, the carrier bottom includes bottom side panels and bottom front and back panels. The bottom front panel includes openings therein and the bottom back panel includes tabs which engage the bottom front panel openings to lock the bottom panel in place. The bottom side panels also include openings which are aligned with some of the bottom front panel openings. The tabs which pass through the bottom front panel openings also pass through the bottom side panel openings where the openings are aligned. The bottom front panel tabs each include an inner tab forming slot spaced from an outer edge of said tab and a tab extension extending from said tab outer edge. The tab inner tab engages a first edge of the bottom front panel openings and the tab extension engages a second edge of the bottom front panel openings.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
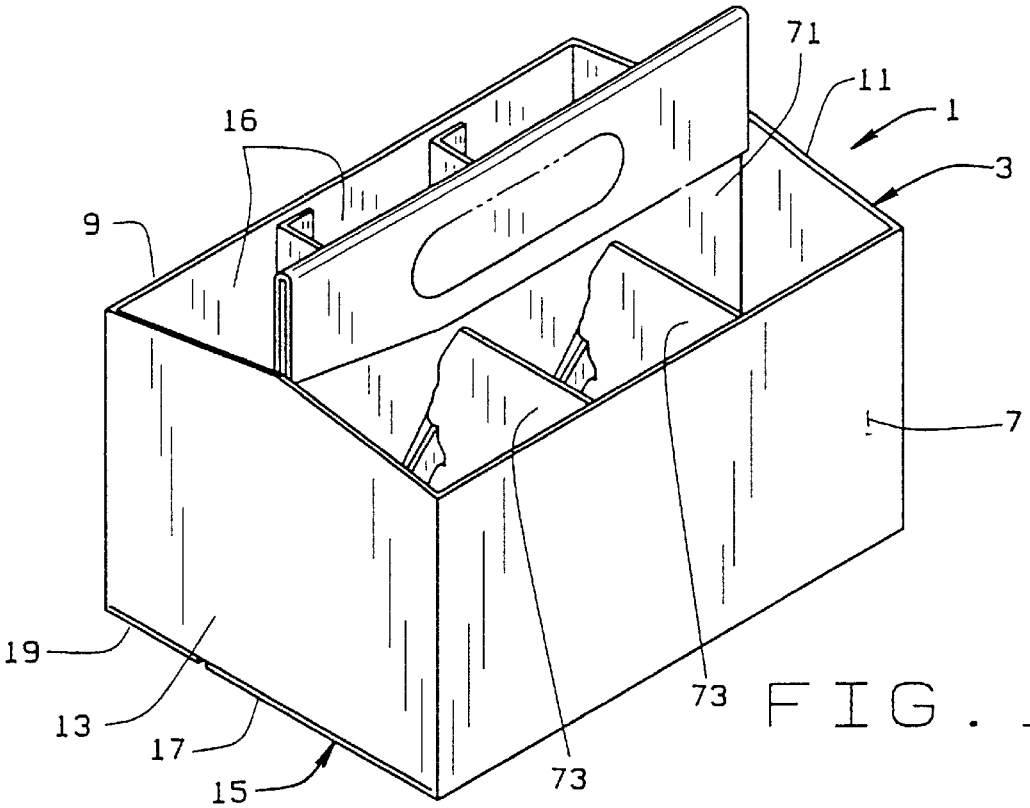
FIG. 1 is a perspective view of an assembled carrier of the present invention.

A carrier 1 of the present invention is shown generally in FIG. 1. The carrier 1 comprises a carrier box 3 and a separate partition assembly 5 which is glued or otherwise fixed inside of the box 3. The carrier box 3 has front and back walls 7 and 9, side walls 11 and 13, and a bottom 15 made of two flaps 17 and 19. The partition assembly 5 divides the interior space of the carrier box 3 into a number of bottle cells 16, in this case six, for respectively receiving and protecting the individual bottles during shipping and rough handling. The partition extends the full height of the carrier and has no openings through which the cells 16 can communicate, that is, there are no openings in the partition sufficiently large that the bottles in adjacent cells can contact each other. Thus, the bottles are protected from contacting each other during movement.

Figure 3:
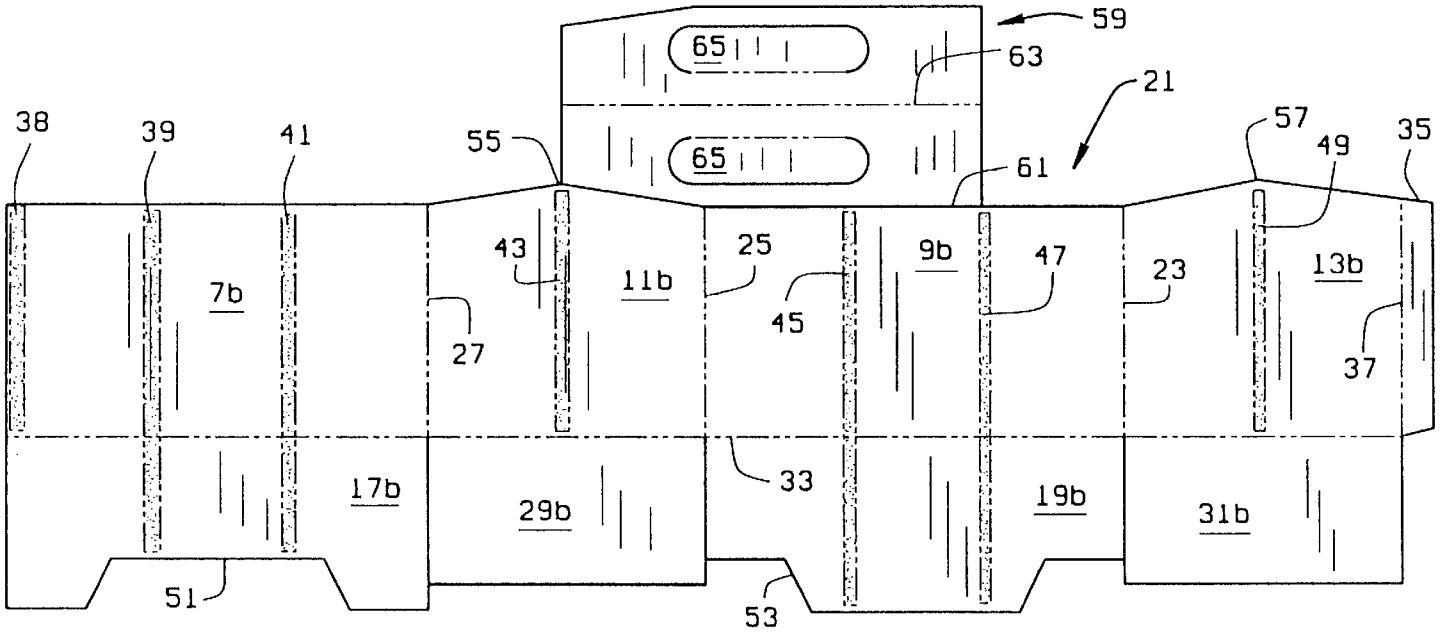
FIG. 3 is a plan view of a blank used to form the outer surfaces of the carrier.
Figure 5:
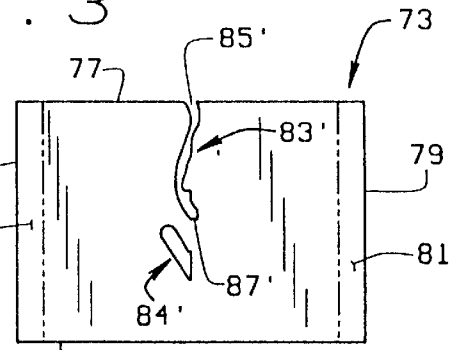
FIGS. 4 and 5 are plan view of blanks used to form the partition assembly.

The carrier box 3 is formed from a single blank 21 shown in FIG. 3. The blank 21 has is dividable into four sections 7*b*, 9*b*, 11*b*, and 13*b* which correspond to the front and back 7 and 9, and the sides 11, and 13, respectively. The four sections are joined hingedly joined together along fold lines 23, 25, and 27. Sections 17*b* and 19*b* depend from sections 7*b* and 9*b*, respectively. Further, there are sections 29*b* and 31*b* which depend from side sections 11*b* and 13*b*. Sections 17*b*, 19*b*, 29*b*, and 31*b* form the bottom 15 of the carrier box 3 when it is folded. The bottom forming sections 17*b*, 19*b*, 29*b* and 31*b* are hingedly joined to the front, back, and side forming sections 7*b*, 9*b*, 11*b*, and 13*b* along a fold line 33. The blank 21 also includes a glue flap 35 which is hingedly connected to section 13*b* along a fold line 37. The fold lines 23, 25, 27, 33, and 37 are preferably formed as a series of elongate scores to facilitate easy folding of the blank into the carrier box 3.

To fold the blank 21 into the carrier box 3, the carrier is simply folded along the various fold lines. The glue tab 35 will be joined to the edge of blank section 7*b*, as can be appreciated, to form the front, back and side walls. In forming the bottom 15, the blank sections 29*b* and 31*b* will be folded prior to the folding of blank sections 17*b* and 19*b*, so that the blank sections 17*b* and 19*b* will form the lower or outer surface of carrier box bottom 15. The upper surfaces of sections 17*b* and 19*b* are fixed to the lower surfaces of sections 29*b* and 31*b* so that the bottom 15 will be maintained together.

Prior to folding, a series of parallel lines of glue 38, 39, 41, 43, 45, 47, and 49 are applied to the carrier. As can be appreciated, the glue tab 35 is adhered to the side forming section 7*b* by the glue line 38. The glue lines 39 and 41 extend from close to the top of section 7*b* and extend nearly to the bottom of section 17*b*. Similarly, the glue lines 45 and 47 extend from close to the top of section 9*b* and extend nearly to the bottom of section 19*b*. The portions of the glue lines 39, 41, 45, and 47 which extend below the fold line 33 serve to glue the sections 17*b* and 19*b* to the sections 29*b* and 31*b* to form the bottom. The sections of glue lines 39, 41, 45, and 47 which extend above the fold line 33, as well as the glue lines 43 and 49 on sections 11*b* and 13*b*, respectively, serve to glue the partition assembly 5 in the carrier box 3, as will be described below.

As can be seen, the section 17*b*, and hence the bottom section 17, is formed generally as a rectangle, but has a trapezoidal section 51 cut out of it. The section 19*b*, and hence the bottom section 19, is also formed generally as a rectangle, but of smaller width than the rectangle of section 17*b*. Section 19*b* has a trapezoidal tab 53 formed on along its outer edge. The trapezoidal tab 53 of section 19*b* conforms in shape and size to the trapezoidal cut out 51 of section 17*b*. When the bottom forming sections 17*b*, 19*b*, 29*b*, and 31*b* are folded to form the carrier box bottom 15, the trapezoidal cut out 51 and tab 53 engage each other. The use of the cut out 51 and tab 53 prevent the formation of a straight line junction between the bottom sections 17 and 19 when the carrier box 3 is formed. This will provide some rigidity and structural integrity to the carrier bottom 15.

As seen in FIG. 3, the top edges of sections 7*b* and 9*b* are flat. However, the sections 11*b* and 13*b*, which form the sides 11 and 13 of the carrier box 3, preferably have top edges which are provided with a small peak 55 and 57 which is generally in the center of the sections 11*b* and 13*b*, respectively. The top edges of the sections 11*b* and 13*b* thus slope downwardly to the fold lines which define the side edges of the respective sections. The slope is preferably small, and forms an angle of about 10° with the horizontal.

Lastly, the carrier box blank 21 is provided with a handle section 59 which extends from the peak 55 of section 11*b* approximately two-thirds of the way across section 9*b*. The handle section 59 is joined to the sections 11*b* and 9*b* by a line of perforations 61. The handle section is symmetrical from top to bottom and a fold line 63 defines its axis of symmetry. It has two generally oval cut outs 65 which form openings through which a user's fingers or hand can extend to carry the carrier 1.

Figure 6:
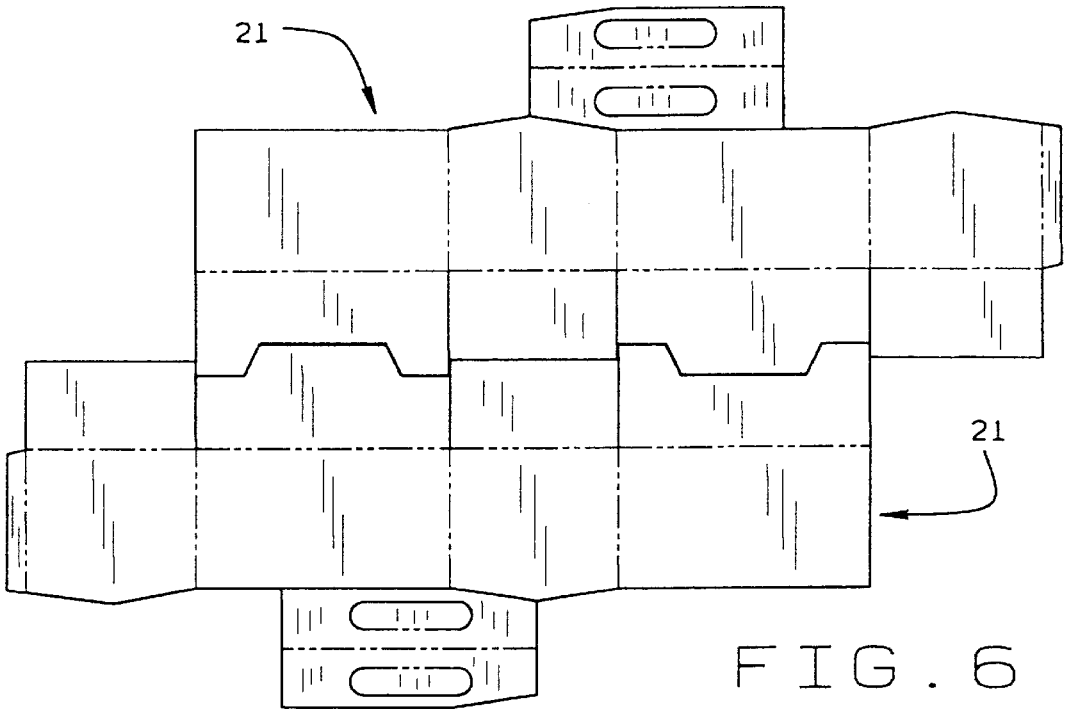
FIG. 6 is a plan view showing the blank of FIG. 3 nested with other blanks.

As can be seen, the carrier box blank 21 is generally simple in shape. It may thus be nested with other blanks on a piece of paperboard, as seen in FIG. 6, so that a plurality of carrier box blanks can be formed at once with minimal waste.

Figure 2:
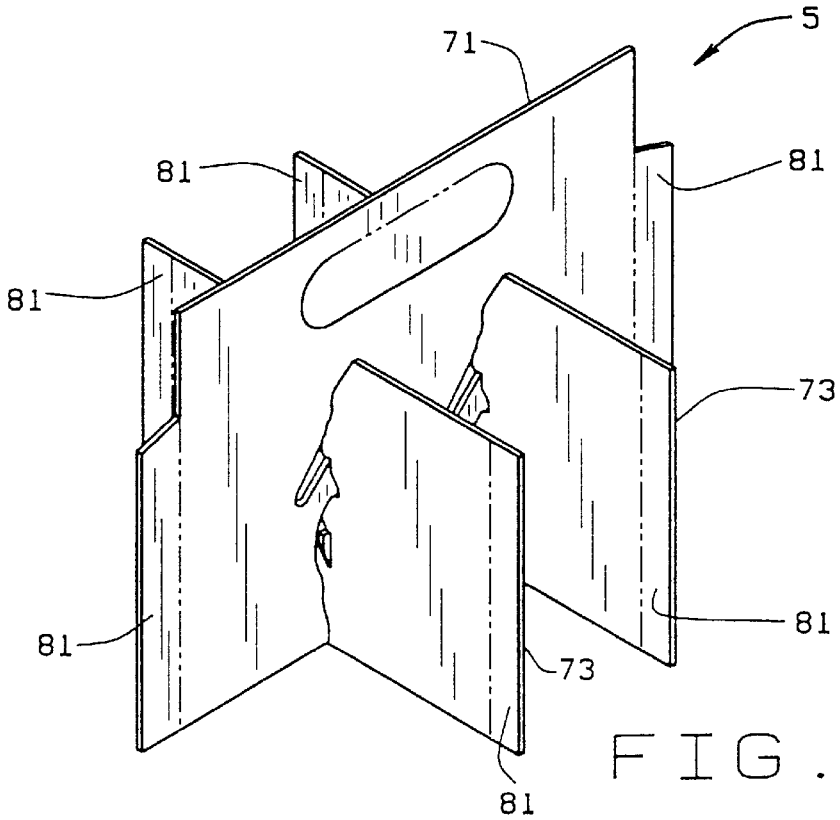
FIG. 2 is a perspective view of an a partition assembly of the present invention.

The partition assembly 5 is formed of a transverse blank or partition 71 which extends between the sides 11 and 13 of the box 3 and two cross blanks or partitions 73 which extend between the front and back walls 7 and 9 of the box 3. The blanks 71 and 73 interengage each other, as shown in FIG. 2. The blanks 71 and 73 are preferably formed in accordance with the disclosure of U.S. Pat. No. 4,103,818, U.S. Pat. No. 4,358,047, and U.S. Pat. No. Re 31,176, all to Wallace O. Raubenheirner, which are assigned to the same assignee as the present invention, and which are incorporated herein by reference.

Briefly stated, each blank or partition has a first edge 75, a second edge 77, and side edges 79. The side edges 79 are provided with glue tabs 81 which are folded along a fold line and are provided to glue the partitions in place in the carrier box 3.

Figure 4:
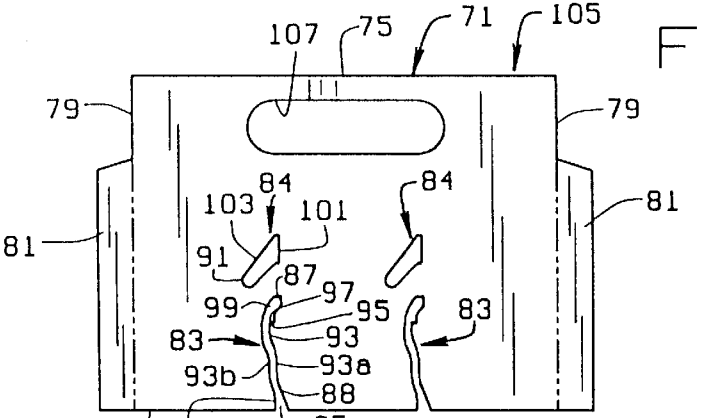

The partitions 71 and 73 are slightly different in construction and will be briefly described. The transverse partition 71 (FIG. 4) has a pair of generally arcuate partition engagement slots 83 which extend from the bottom or second edge 77 of the partition and are generally parallel to the opposite side edges 79 of the partition. The slots 83 are spaced apart to divide the partition 71 substantially into equal thirds. A tab receiving slot 84 is formed above each slot 83. The slots 83 have an opening 85 in the second edge 77 of the partition and extend to a closed end 87 approximately one-third of the way up the partition 71, and approximately two-thirds of the way up the glue tabs 81. The opening 85 has a first generally sloped edge 88 and a second edge 89 opposite edge 88 which forms a small convex. The slope of edge 88 is of an angle such that it would extend to the tip 91 of the tab receiving opening 84.

The edges 88 and 89 converge towards each other and merge into generally parallel side edges 93*a*, 93*b*. At an intermediate location along the length of each slot 83 a locking tab 95 projects laterally into the path of the slot 83 to provide an abutment edge 97 which faces away from the slot open end 85. Preferably, and as shown, this abutment edge 97 projects perpendicularly with respect to the sides 79 of the partition. As can be seen, the side 93*b* curves around the tab 95 so that the edge 93*b* is generally parallel to the opposite edge of the slot. However, as the edge 93*b* continues its curvature, the abutment edge 97 extends away from the edge 93*b* to create a head 99 of the slot 83.

The tab receiving slot 84 is formed generally as a diagonal slot having a flat edge 101 and side edges 103 which converge towards each other to end in the rounded tip 91. The flat edge 101 is generally co-linear with the edge 93*a* of the slot 83 prior to the formation of the tab 95.

Above the glue tabs 81, a handle section 105 is formed which has a finger or hand receiving hole 107.

The cross-partitions 73, as noted, are substantially similar to the transverse partition 71. It is generally rectangular in shape, having a height equal to the height of the box 3 and a length equal to the width of the box 3. It has a slot 83' which extends into the partition 73 from its second edge 77 and extends about two-thirds of the partition 73 to end in a closed end 87'. The configuration of the slot 83' of partition 73 is substantially identical to the slot 83 of partition 71. However, the slot 83' does not have the sloped edge 87 and the convex edge 89 at its opening 85', as does the slot 83 of partition 71. The partition 71 also has a diagonally extending tab receiving slot 84' spaced beneath the end of the slot 83'.

As will be apparent, the partitions 71 and 73 are assembled and interlocked to form the partition assembly by moving the open end 85' of slot 83' into one of the slots 83 of the partition 71. The two partitions 71 and 73 are connected together to the fullest possible extent so that, when fully engaged with each other the edges 77 of the partitions are co-planar. The assembly of the partition assembly 5 can be automated, as set forth in the above noted patents.

As can be appreciated, the partition assemble 5 and the carrier box 3, once formed, can be collapsed, to be substantially flat. To assembly the carrier 1, a formed box 3 is taken from its collapsed, flattened condition, is squared, and the bottom is formed, as noted above. A flattened partition assembly 5 is also squared and its glue tabs 81 are folded along the fold lines 81. The partition assembly 5 is then inserted in the formed carrier box 3 such that the glue tabs 81 are aligned with the respective glue lines 39, 41, 43, 45, 47, and 49. The glue, which may be a pressure activated glue, is activated to glue the partition assembly 5 in the carrier box 3 to form the carrier 1. Prior to formation of the carrier box 3, the handle section 59 of the blank 21 is removed. The handle section 59 is folded about its fold line 63 and then glued, or otherwise affixed, to the handle section 105 of the transverse partition 71. This produces a three-ply handle, which is stronger then the handles on current carriers.

As will be appreciated, the carrier 1 of the present invention is made of three blank forms, each of which is fairly simple in shape and construction, and each of which may be formed with minimal waste. The carrier box 3 is formed without the need to make glue lines in multiple directions. In fact, all the glue lines on the blank 21 are parallel. This will allow for increased production of carrier boxes. The simple configuration of the carrier box blank 21 also allows for continuous graphics an all panels, versus the interrupted side panels which are on currently used carrier blanks. The glued bottom will substantially reduce the side-to-side racking of the carrier as it is transported, and the elimination of a center fold in the bottom will substantially prevent sagging of the carrier bottom, as occurs on currently available carriers. Lastly, because the blanks are simple in construction, the carrier boxes 3 and partition assemblies 5 can be set up on erecting equipment which can be operated to produce 150 carriers per minute, as opposed to the 60 carriers per minute which can be produced with the complex carriers currently available.

Figure 7:
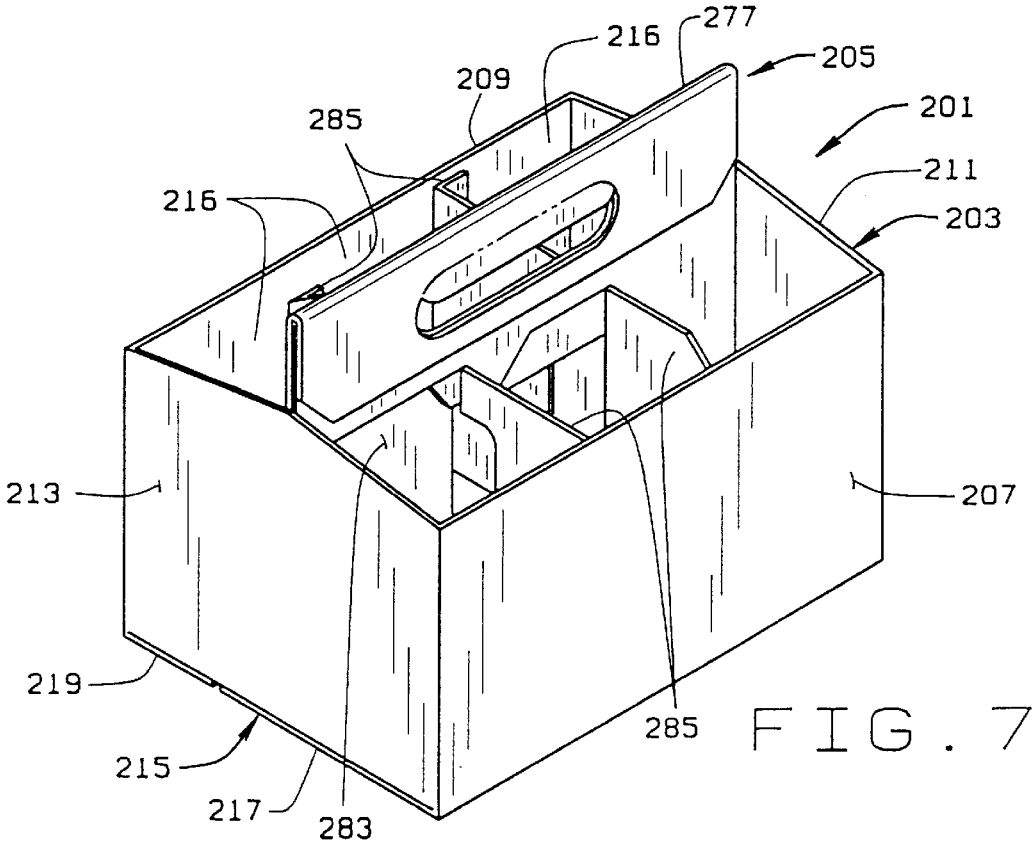
FIG. 7 is a perspective view of an alternative and preferred embodiment of the carrier.

An alternative carrier 201 is shown in FIG. 7. The carrier 201 includes a carrier box 203 and a partition 205. Both the carrier box 203 and the partition 205 are formed from a one-piece blank. Because the partition is a one-piece partition, assembly of the partition will be easier than the assembly of the partition 5 of FIG. 2.

The carrier box 203 has front and back walls 207 and 209, side walls 211 and 213, and a bottom 215 made of two flaps 217 and 219. The partition assembly 205 divides the interior space of the carrier box 203 into a number of bottle cells 216, in this case six, for respectively receiving and protecting the individual bottles during shipping and rough handling. The partition extends the full height of the carrier. Unlike the partition 5 of FIG. 2, the partition 205 has openings through which the middle two cells 216 communicate.

Figure 8:
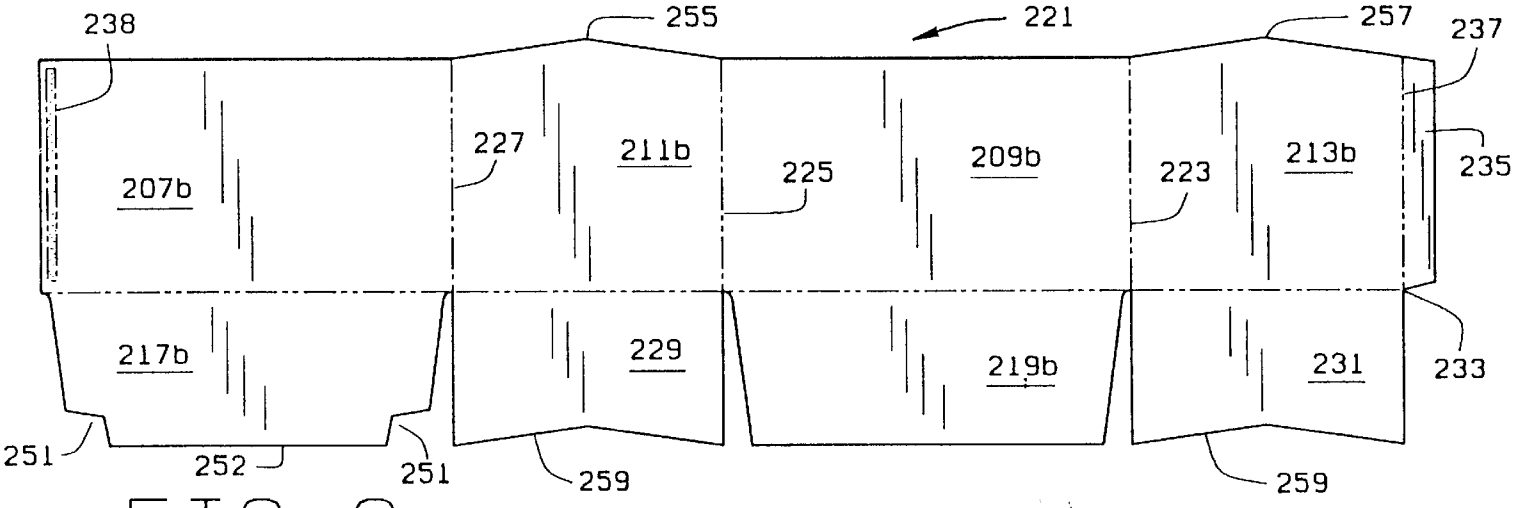
FIG. 8 is a plan view of a blank used to form the outer surfaces of the carrier of FIG. 7.

The carrier box 203 is formed from a single blank 221 shown in FIG. 8. The blank 221 has is dividable into four sections 207*b,* 209*b,* 211*b,* and 213*b* which correspond to the front 207 and back 209, and the sides 211 and 213, respectively. The four sections are hingedly joined together along fold lines 223, 225, and 227. Sections 217*b* and 219*b* depend from sections 207*b* and 209*b,* respectively. Further, there are sections 229*b* and 231*b* which depend from side sections 211*b* and 213*b*. Sections 217*b,* 219*b,* 229*b,* and 231*b* form the bottom 215 of the carrier box 203 when it is folded. The bottom forming sections 217*b,* 219*b,* 229*b* and 231*b* are hingedly joined to the front, back, and side forming sections 207*b,* 209*b,* 211*b,* and 213*b* along a fold line 233. The blank 221 also includes a glue flap 235 which is hingedly connected to section 213*b* along a fold line 237. The fold lines 223, 225, 227, 233, and 237 are preferably formed as a series of elongate scores to facilitate easy folding of the blank into the carrier box 203.

To fold the blank 221 into the carrier box 203 is shown in FIGS. 19–22. To form the box from the blank, the blank is simply folded along the various fold lines. The glue tab 235 will be joined to the edge of blank section 207*b,* as can be appreciated, to form the front, back and side walls. In forming the bottom 215, the blank sections 229*b* and 231*b* will be folded prior to the folding of blank sections 217*b* and 219*b,* so that the blank sections 217*b* and 219*b* will form the lower or outer surface of carrier box bottom 215. The upper surfaces of sections 217*b* and 219*b* are fixed to the lower surfaces of sections 229*b* and 231*b,* such as by an adhesive, so that the bottom 215 will be maintained together.

Prior to folding, a glue line 238 is are applied to the carrier. As can be appreciated, the glue tab 235 is adhered to the side forming section 207*b* by the glue line 238. This will maintain the carrier box 203 in its formed state.

As can be seen, the section 217*b,* and hence the bottom section 217, is formed generally as a trapezoid, but has cutouts 251 formed at its comers. The cutouts 251 effectively form a tab 252 at the end of section 217*b*. The section 219*b,* and hence the bottom section 219, is also formed generally as a trapezoid. When the bottom forming sections 217*b,* 219*b,* 229*b,* and 231*b* are folded to form the carrier box bottom 215, the tab 252 of section 217*b* overlies the end of section 219*b*. The use of the tab 252 prevents the formation of a straight line junction between the bottom sections 217 and 219 when the carrier box 203 is formed. This will provide some rigidity and structural integrity to the carrier bottom 215.

The top edges of sections 207*b* and 209*b* are flat. However, the sections 211*b* and 213*b,* which form the sides 211 and 213 of the carrier box 203, preferably have top edges which are provided with a small peak 255 and 257 which is generally in the center of the sections 211*b* and 213*b,* respectively. The top edges of the sections 211*b* and 213*b* thus slope downwardly to the fold lines which define the side edges of the respective sections. The slope is preferably small, and forms an angle of about 10° with the horizontal.

The bottom edges 259 of bottom panel sections 229 and 231 have inwardly directed edges which form inwardly directed triangles. The triangle defined by the edges 259 corresponds in size to the slope of the peaks 255 and 257 of the side panels 211*b* and 213*b*. Thus, carrier blanks may be nested one on top of another, so that a plurality of carrier box blanks can be formed at once with minimal waste.

Figure 9:
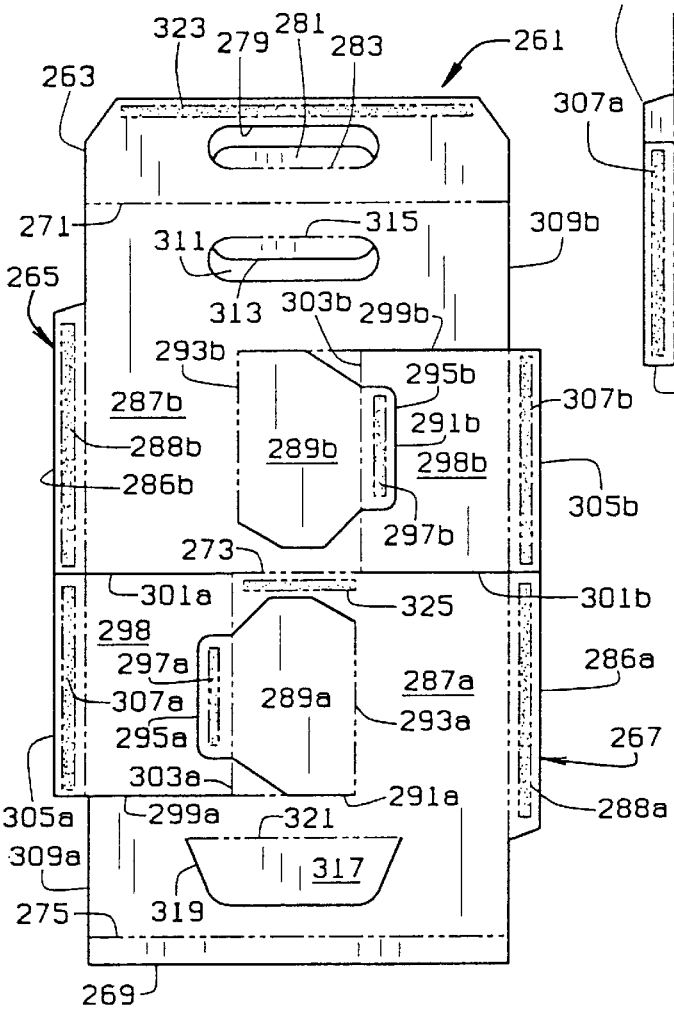
FIG. 9 is a plan view of a blank used to form the partition of the carrier of FIG. 7

The blank 261 from which the partition 205 is formed is shown in FIG. 9. The blank 261 is formed from one piece of paperboard, so that the partition 205 is a one-piece partition from which both the longitudinal and lateral dividers are formed. The blank 261 is divided into four sections, 263, 265, 267 and 269, which are separated by fold lines 271, 273, and 275. The section 263 forms part of the handle 277 (FIG. 7) of the carrier 201, and includes a cutout 279 sized to allow the fingers of a user's hand to pass therethrough so that the carrier 203 can be lifted by the handle. A small foldable tab 281 extends into the cutout 279 and is foldable about a fold line 283.

The sections 265 and 267 are substantially similar to each other and form the longitudinal divider 283 and the lateral dividers 285 which divide the carrier box 203 into the bottle cells 216 and the handle of the carrier. The sections 265 and 267 each include a body portion 287*a,b* which forms the longitudinal divider 283. Glue tabs 286*,b* are formed along the sides of the body portions 287*a,b* and an adhesive strip 288*a,b* is printed on each tab. A middle section 289*a,b* is defined in the center of the sections 265 and 267 by a slice 291*a,b* which defines the shape of the sections 289*a,b*. The middle sections 289*a,b* are foldable about a fold line 293*a,b,* and when the partition is formed, the sections 289*a,b* form two of the partition's lateral dividers 285. The middle sections 289*a,b* each have a tab 295*a,b* upon which an adhesive strip 297*a,b* is printed. A second pair of lateral dividers 298*a,b* are formed by slices 299*a,b* and 301*a,b* and are foldable about a fold line 303*a,b*. As seen, the slices 301*a,b* are colinear with each other and with the fold line 273 which separates the two sections 265 and 267. Glue tabs 305*a,b* are formed at the ends of the dividers 298*a,b* and adhesive strips 307*a,b* are printed on the glue tabs 305*a,b*. The adhesive strips 307*a,b* can be a continuation of the adhesive strips 288*a,b*. The sections 265 and 267, as noted, form the handle 277 of the carrier, and have handle portions 309*a,b*. The handle portion 309*b* has a cutout 311 identical to the cutout 279 in the section 263. A tab 313 extends into the cutout 311 and is foldable along a fold line 315. Handle portion 309*a* includes a section 317 defined by a slice 319 and a fold line 321. Section 317, when folded, creates an opening in the handle portion 309*a* to complete the grip hole in the handle 277.

Figure 10:
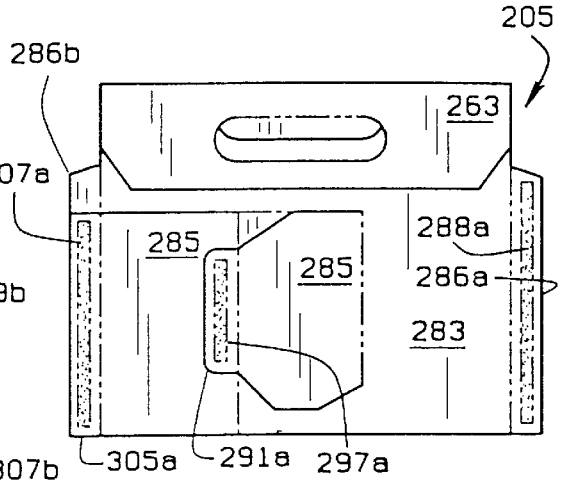
FIG. 10 is a plan view of the partition blank of FIG. 9 folded.

To form the partition 205 from the blank 261, the portion 317 is first folded inwardly along the fold line 321. The blank is then folded in half about the center fold line 273 (and the slices 301*a,b*). This will bring the handle portions 309*a,b* of the sections 265 and 267 into contact with each other. The section 263 is then folded about fold line 271 to cover the handle portion 309*a* of section 267. When the section 263 is folded over, the section 269 will be forced to fold about its fold line 225. The then folded partition will appear as shown in FIG. 10. The folded partition is maintained in its folded state by adhesive. To maintain the partition 205 in the folded state, an adhesive strip 323 is printed along the top of section 263 (with reference to FIG. 9) and an adhesive strip 325 is printed on one section 265 or section 267 adjacent the fold line 273. When the blank 261 is folded, the adhesive strip 323 will come into contact with the handle portion 309*a* of section 267 at a point below the handle opening (with reference to FIG. 10). The adhesive strip 325 adjacent the fold line 273 between sections 265 and 267 will hold the partition together at the bottom thereof (again with reference to FIG. 10).

Figure 11:
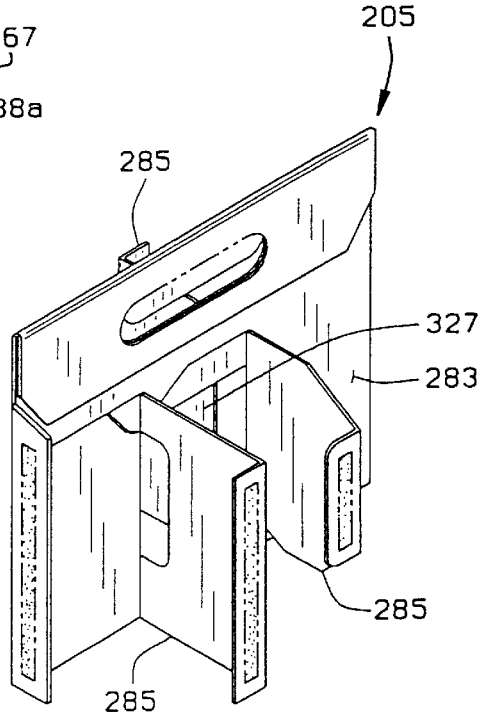
FIG. 11 is a plan view of the partition formed from the partition blank of FIG. 9.
Figure 13:
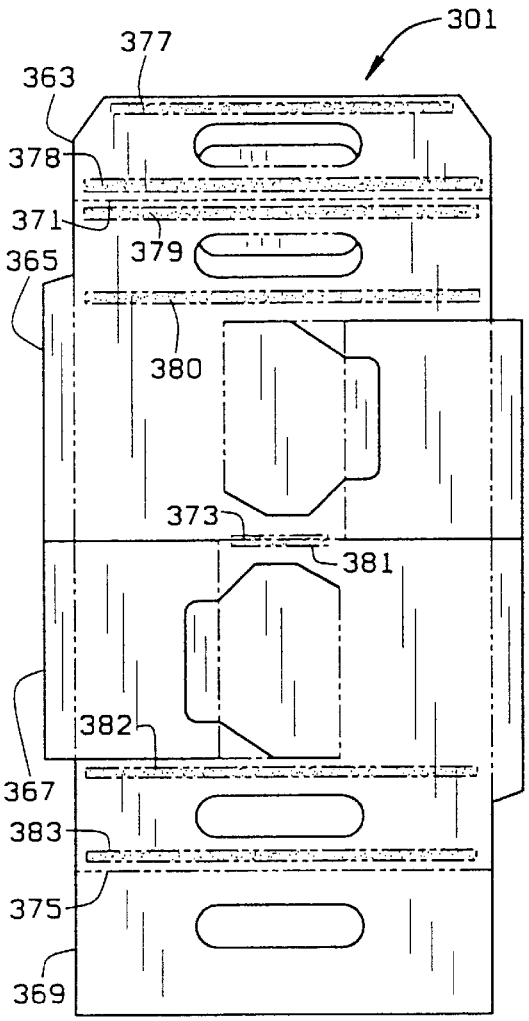
FIGS. 13–18 show plan view of blanks for alternate partitions for use with the carrier blank of FIG. 8.
Figure 14:
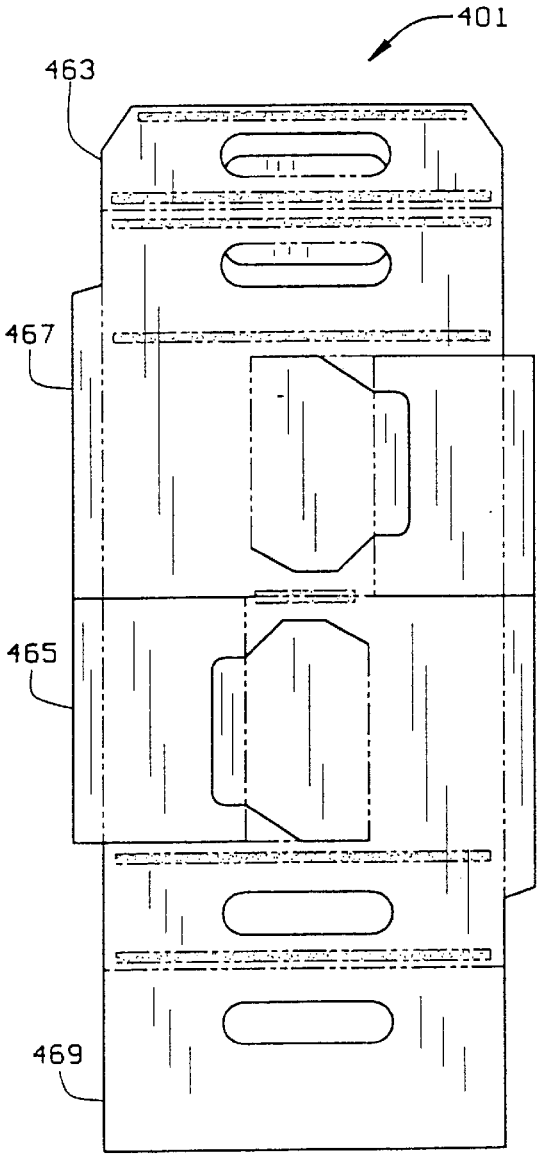
Figure 15:
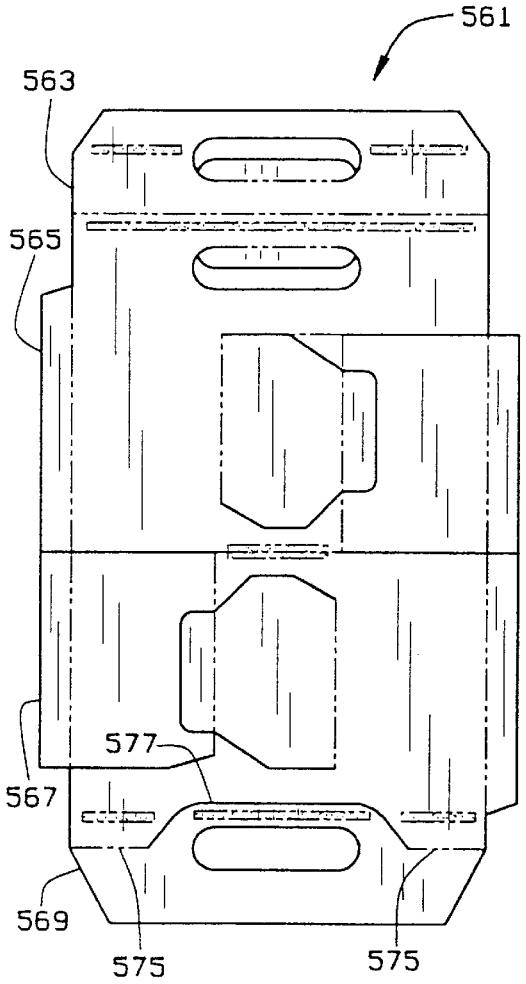
Figure 16:
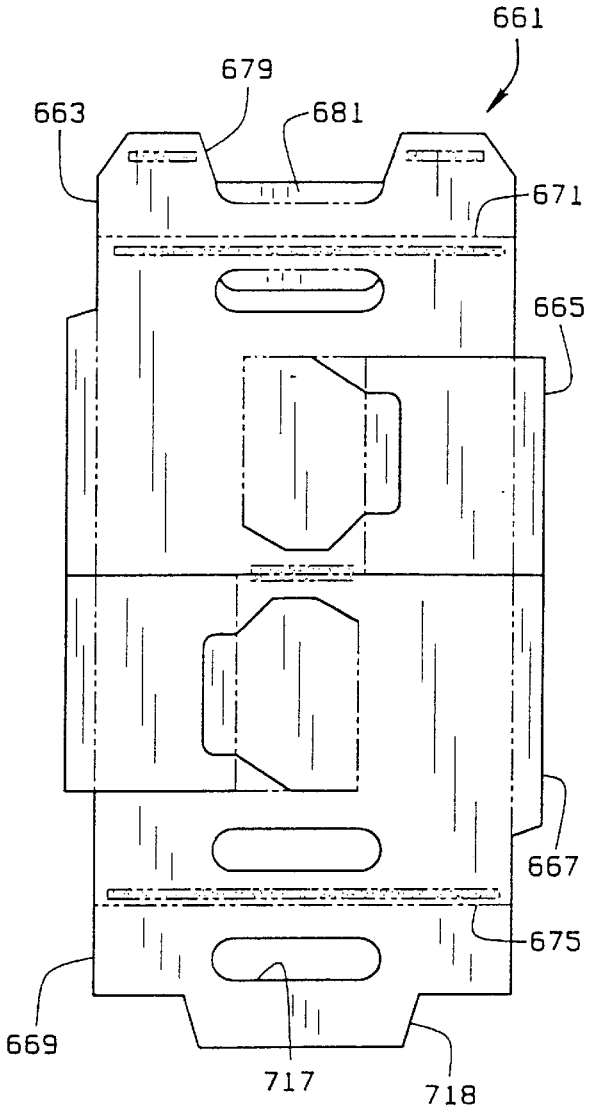
Figure 18:
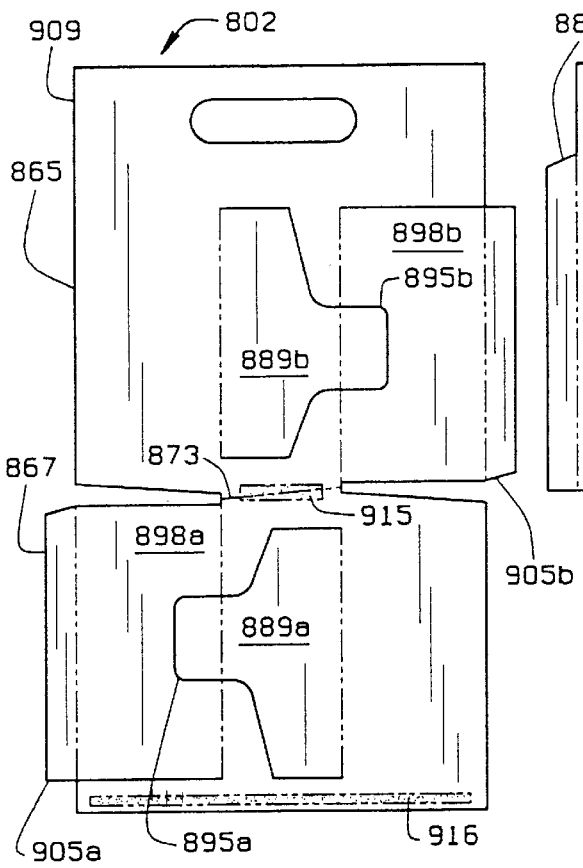
Figure 17:
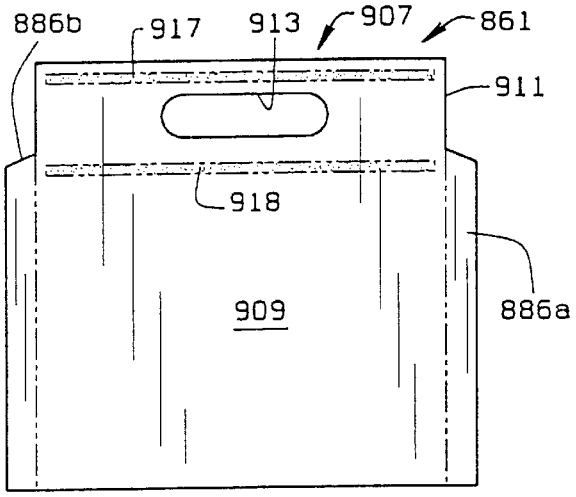
Figure 17:
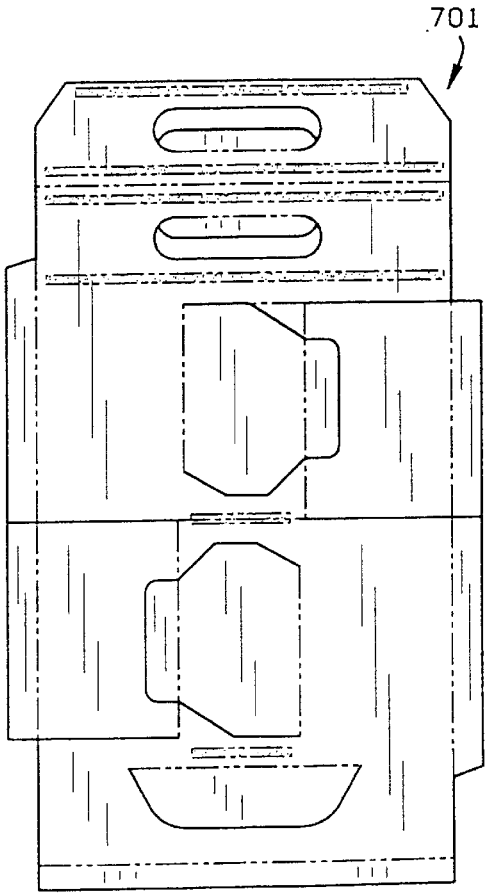
Figure 19:
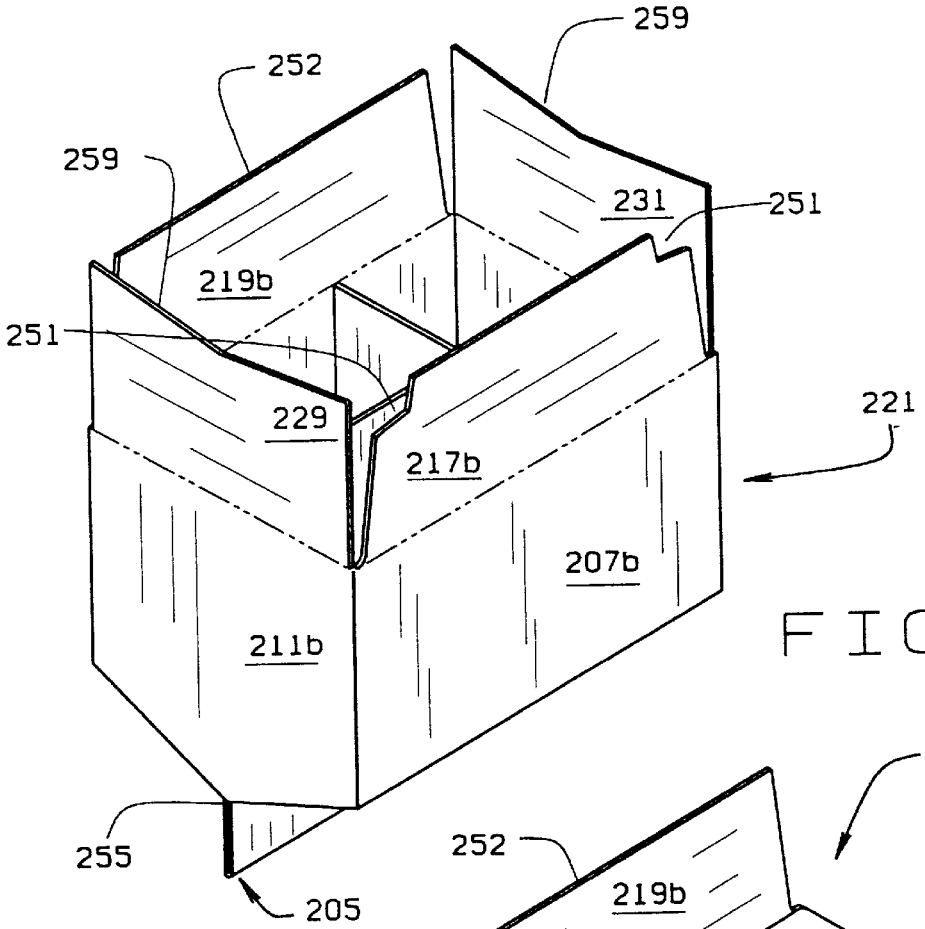
FIGS. 19–22 are bottom perspective views showing the folding of the bottom of the carrier of FIG. 8.
Figure 20:
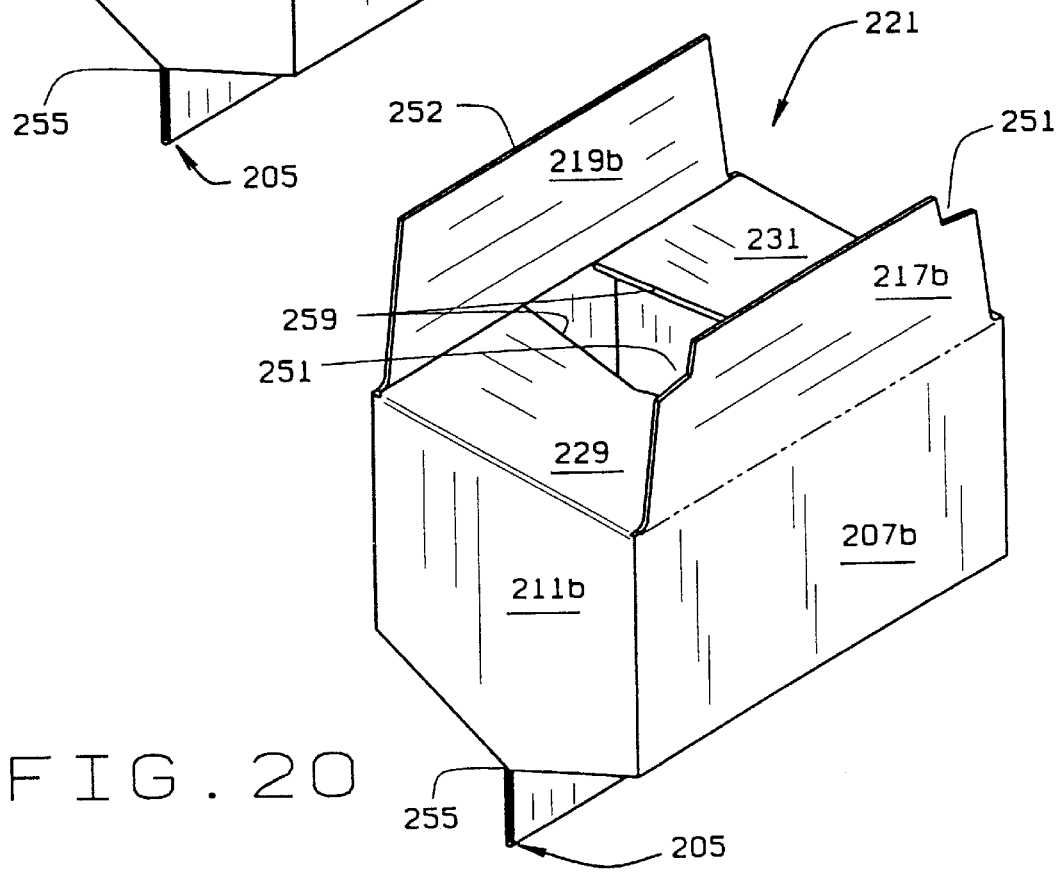
Figure 21:
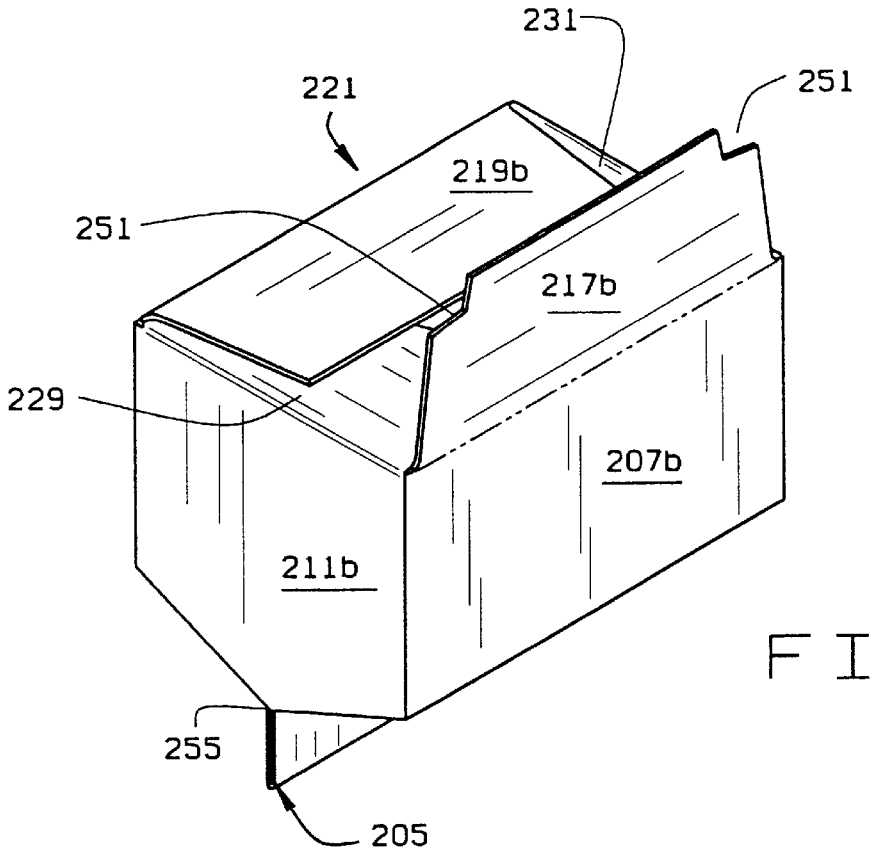
Figure 22:
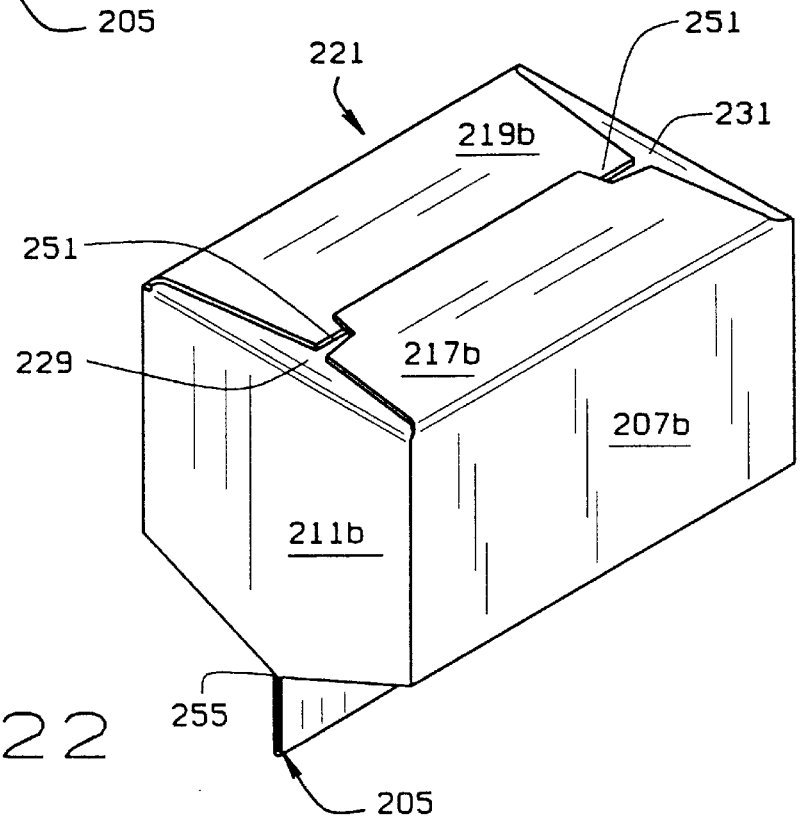

To form the partition 205, as shown in FIG. 11, from the folded partition show in FIG. 10, the four lateral dividers 285 are folded out from the longitudinal divider 283. This will create an opening 327 which allows the two middle bottle cells to communicate with each other. The design of the blank creates a solid wall between the outer pairs of bottle cells.

Figure 12:
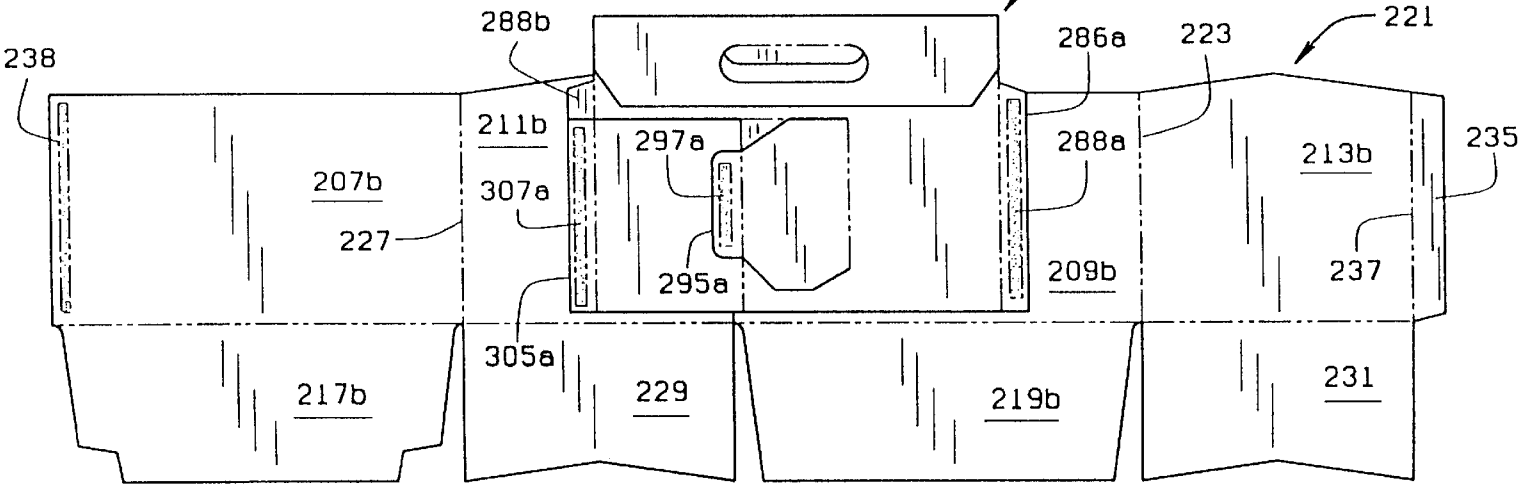
FIG. 12 is a plan view of the carrier blank with a partition blank glued therein for assembling the carrier.

To assemble the carrier 201, the folded (but flat) partition 205 is glued in place to the inner surface of the carrier box blank 221, as shown in FIG. 12. The glue tab 288*b* is adhered to the blank section 211*b*, and the glue tabs 291*b* and 305*b* are adhered to the blank section 209*b*. This will adhere one edge of the longitudinal divider to one side of the carrier box and the lateral dividers to the back of the carrier box. The blank section 213*b* is then folded about fold line 223 so that the section 213 contacts the adhesive strip 288*a* of glue tab 286*a*. This will adhere the longitudinal divider to the side wall of the carrier. The blank section 207*b* is then folded about fold line 227 to bring the section 207*b* into contact with the glue tabs 305*a* and 295*a* and their respective adhesive strips 307*a* and 297*a*, respectively, to adhere the second set of lateral dividers to the front wall of the carrier box. The adhesive strip 238 at the edge of the box blank section 207*b* will also contact the glue tab 235 to adhere the glue tab 235 to the section 207*b*. This will hold the carrier box 205 in an assembled state. The box is then stored and shipped flat (i.e., prior to forming of the bottom of the carrier).

To complete formation of the carrier 201, the carrier box is expanded from its flattened state to an open state, such as shown in FIG. 7. The bottom of the carrier 205 is then formed by first folding in the sections 229 and 231. Then the section 219*b* is folded about its fold line and finally the section 217*b* is folded about its fold line. Appropriate strips of adhesive are provided on the bottom flaps 217*b*, 219*b*, 229 and 231 to hold the bottom together so that the bottom of the carrier 201 will support the bottles carried therein.

FIGS. 13–18 show blanks for alternative partitions for use with the carrier box blank 221. The blank 361 forms a four ply handle, rather than the three ply handle formed by blank 261. The blank 361 has sections 363, 365, 367, and 369 which are connected along fold lines 371, 373, and 375. The two center sections 365 and 367 define the body of the partition (including the longitudinal and lateral dividers of the partition) as well as part of the handle of the carrier. The sections 363 and 369 form two of the four plies of the handle. To assemble the blank 361 into a partition, the section 369 is first folded about fold line 375. The blank is then folded about fold line 373. This brings the fold line 375 to a position adjacent the fold line 371. The handle section 363 is then folded about fold line 371 to lie over the handle portion of section 367, section 369 being positioned between sections 367 and 365. To maintain the blank in its folded state, adhesive strips 377–382 are printed on the blank, as shown.

The blank 461 (FIG. 14) also forms a four ply handle. Blank 461 will form a partition substantially the same as the partition formed by the blank 361. However, the handle sections 463 and 469 and the body sections 465 and 467 are larger than the analogous sections of blank 361. Thus, the partition formed by blank 461 will have deeper bottle cells than the partition formed by blank 361.

The blank 561 (FIG. 15) is similar to the blank 261 of FIG. 9. The blank 561 includes sections 563, 565, 567, and 566. Like blank 261, sections 565 and 567 form the body of the partition and part of the handle of the carrier. The sections 563 and 569 form the handle of the carrier. Section 563 and 565 are substantially identical to sections 263 and 265. Section 569 is somewhat different from section 269, and section 567 differs from section 267 due to the change in section 569. Section 569 is hingedly connected to section 567 about a fold line 575. The fold line 575 is interrupted by a cut 577 which arcs inwardly into section 567. When the section 569 is folded about fold line 575, the section defined by the cut 577 will flip up (i.e., away from section 567) to define a portion of the handle of the carrier.

The partition blank 661 (FIG. 16) differs from partition blanks of FIGS. 9 and 13–15 in the formation of the handle. The handle formed by blank 661 is defined by sections 669 and 663 of the blank which fold about fold lines 675 and 671, respectively. Rather than having a finger hole formed in it, section 663 includes a generally trapezoidal cutout 679 which includes a tab 681. Section 669, rather than including the folding section 317 (FIG. 9) includes a finger cutout 717. It also includes a trapezoidal tab 718 which extends away from section 667. When folded, section 669 is first folded about its fold line so that it will lie against section 667. Section 667 is then folded about its fold line so that section 669 will be sandwiched between sections 665 and 667. Finally, section 663 is folded over section 667. The cutout 679 in section 663 is sized to encompass or frame the cutout 717 of section 669. The tab 718 is sized so that it will extend beyond the edge of the section 689*a* so that it will overlie a portion of the opening created when the lateral dividers are folded away from the body of the partition.

The blank 761 (FIG. 17) is substantially identical to the blank 261 (FIG. 9). However, it varies in the lengths of the sections to create bottle cells which are deeper than the bottle cells defined by partition formed by blank 261. This will form a blank that can accept taller bottles.

Lastly, the blank 861 (FIG. 18) is substantially different than the blanks of FIGS. 9 and 13–17. Rather than being a one piece partition, the partition consists of two blanks. A first blank 862 includes sections 865 and 867 which form the body of the partition, and include the foldable sections 889*a,b* and 898*a,b* which form the lateral dividers of the partition. The sections 865 and 867 are hingedly connected by a fold line 873. Section 865 has a handle forming section 909, but section 867 lacks any similar handle forming section. Sections 865 and 867 also include the glue tabs 895*a,b* and 905*a,b* for the lateral dividers. However, it does not include glue tabs for the longitudinal divider. The second blank 907 forms the body of the partition (and hence the longitudinal divider) and includes a body section 909 having glue tabs 886*a,b* on opposing sides thereof and a handle section 911 having a hand opening 913. To form the partition from blank 861, the sections 865 and 867 are folded together and the blank 907 is positioned to be sandwiched between the two sections of blank 862. The blank 873 includes adhesive strips 915 and 916 and blank 907 has adhesive strips 917 and 918. The adhesive strip 915 is at the fold line 873 and anchors the bottom edge of the blank 907 in place between the blank sections 865 and 867. The adhesive strip 916 is at a bottom edge of section 867 (with reference to FIG. 18), and contacts a surface of the blank 907. The adhesive strips 917 and 918 of blank 907 are positioned above and below, respectively, the hand hole 913 and adhere the handle portion 911 of blank 907 to the handle portion 909 of blank section 865.

The blanks of FIGS. 9 and 13–18 have the advantage of being easier to assemble into the partition than the blanks 71 and 73 which form the partition 5 of FIG. 2. This will serve to speed up manufacture of the partition, and hence manufacture of the carriers made using the partitions.

Figure 23:
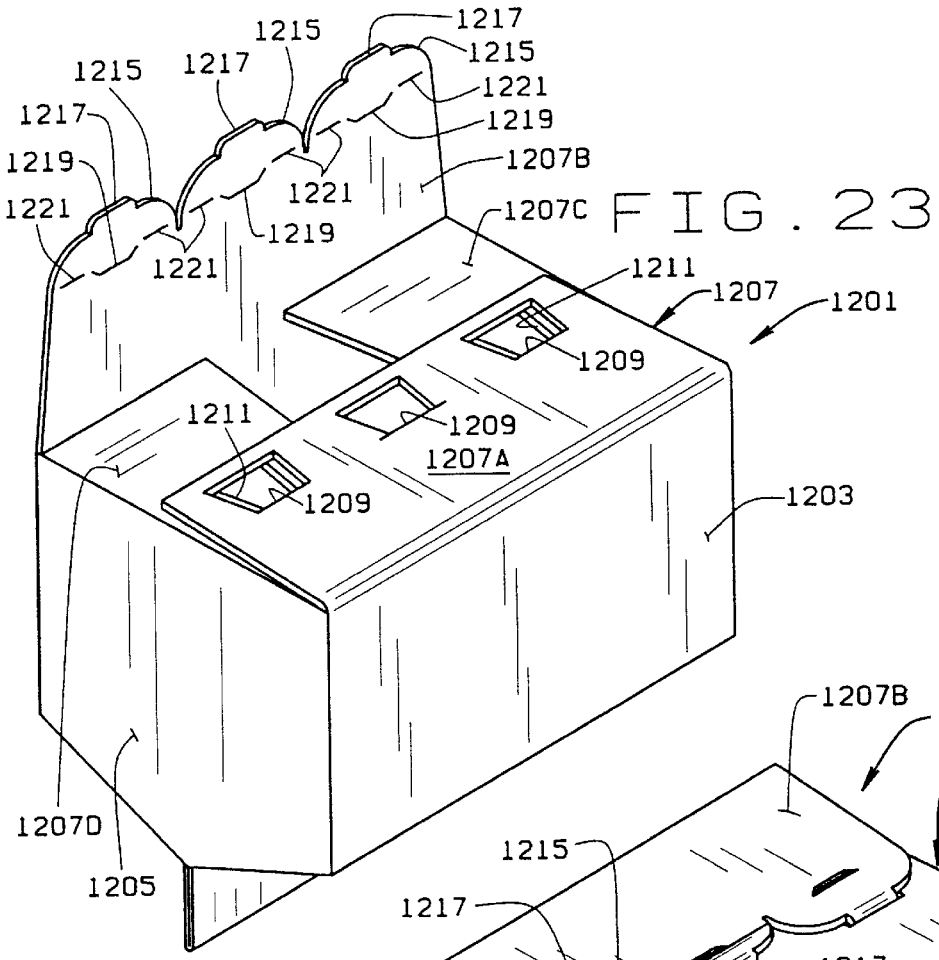
FIG. 23 is a plan view of a blank for forming a third embodiment of the carrier in which the carrier has a locking bottom.
Figure 24:
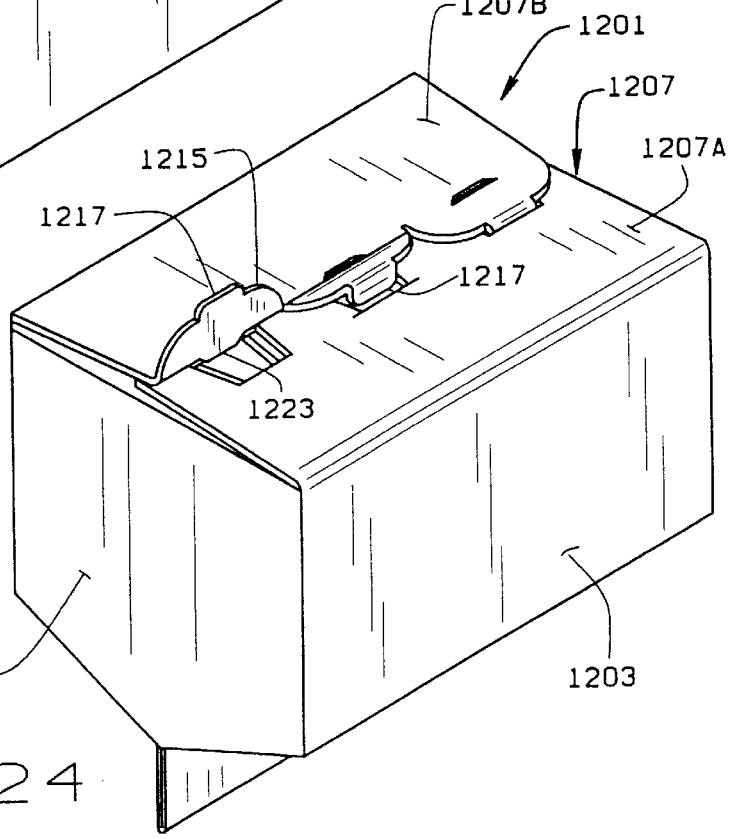
FIG. 24 is a bottom perspective view of a carrier formed from the blank of FIG. 23, the carrier being shown in a partly folded position.
Figure 25:
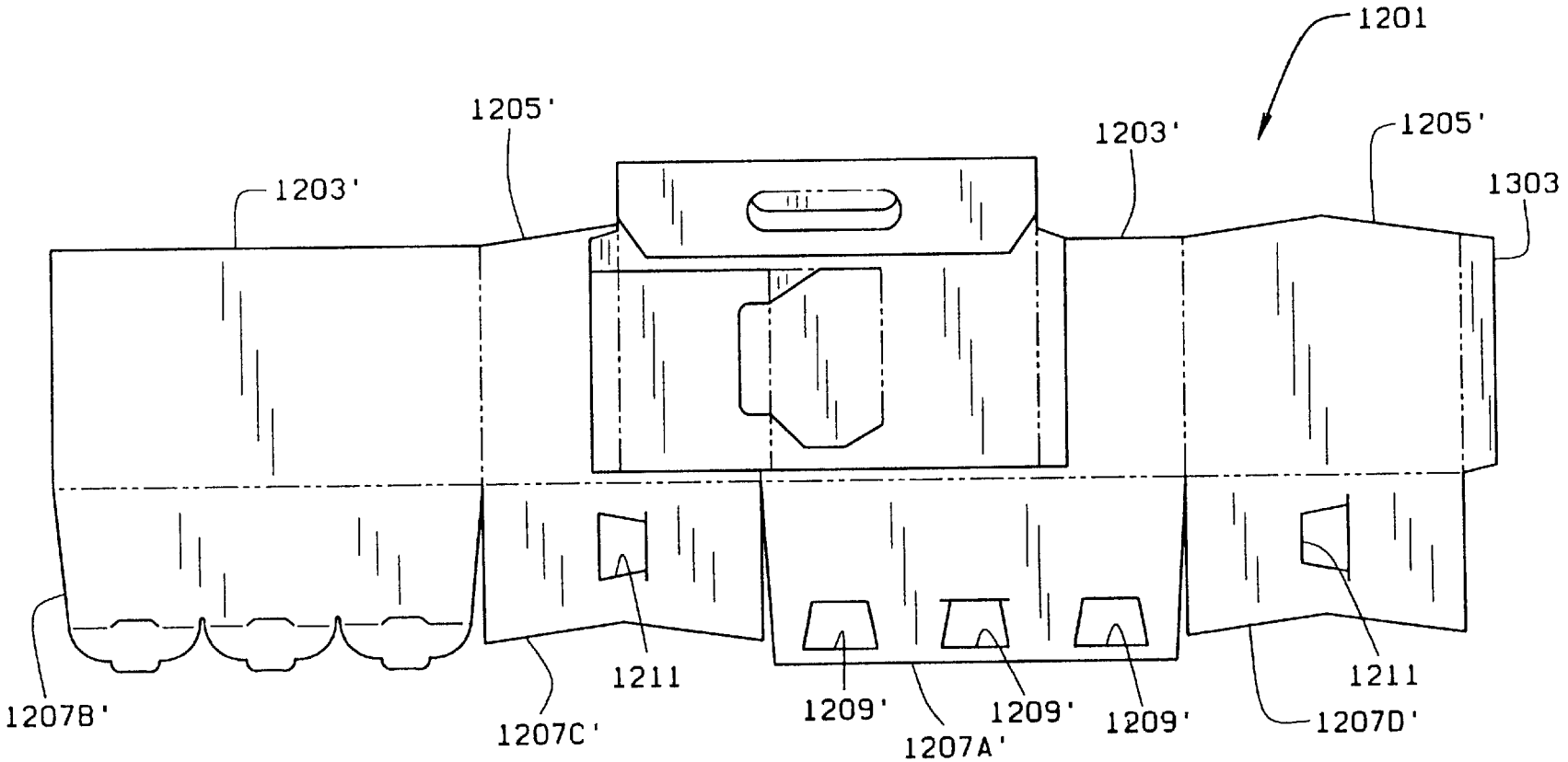
FIG. 25 is a bottom perspective view of the carrier of FIG. 24 when folded.

A second embodiment of the carrier 1201 is shown in FIGS. 23 and 24. The blank 1301 from which the carrier is formed is shown in FIG. 25. The reference numbers for the blank are the same as for the carrier, however, the are given primes. The carrier 1201 includes a front and a back 1203, sides 1205, and a bottom 1207. The front, back, and side panels are connected along hinge lines. One of the side panels has a glue tab to which the front (or back) panel is glued to give the carrier its quadrilateral shape. The top, bottom, and side panels, thus are substantially the same as the corresponding panels of the carrier 1. The bottom panel, however is different.

The bottom 1207 comprises two outer flaps 1207A,B which extend from the front and back panels 1203 and two inner or dust panels 1207C,D which extend from the side panels 1205. The bottom panel flap 1207A include three spaced apart openings 1209. The openings 1209 are evenly spaced along the panel 1207A. They are also preferably trapezoidal in shape, and the edge of the opening 1209 that is closer to the edge of the panel is wider than the edge of the opening that is closer to the hinge line which connects the panel 1209A to the side panel 1203. The openings 1209 thus face towards the front panel 1203, as best seen in FIG. 25. The dust flaps 1207C,D also include openings 1211 which are shaped identically to the openings 1209 of the panel 1207A. In the blank 1301, as seen in FIG. 25, the dust panel openings 1211 face each other. The openings 1211 are positioned on the dust panels 1207C,D such that when the carrier is folded, the openings 1211 will be aligned with the openings 1209, as seen in FIG. 23. Lastly, the flap 1207B has three tabs 1215 which are positioned at the free end of the flap 1207B and shaped to be received in the openings 1209 and 1211, as seen in FIG. 24. The tabs 1215 each have an extension 1217 extending from the edge of the tab in the middle thereof. Opposite the tab extension 1217, the tabs 1215 include a small slice 1219 which is generally trapezoidal in shape, and has a back edge and two side edges which extend away from the back edge. The slice 1219 thus opens toward the tab extension 1217. Fold lines 1221 extend outwardly from the slice 1219 along a line generally parallel to the fold line connecting the panel 1207B to the back (or front) 1203.

To assemble the carrier 1201 from the blank 1301, the front panel 1203' is glued to the glue tab 1303 (FIG. 25) to give the carrier its quadrilateral (in top plan) shape. The dust flaps 1207C,D are then folded inwardly. The bottom flap 1207A is then folded over to bring the openings 1209 into alignment over the openings 1211. Lastly, the bottom flap 1207B is folded over. As shown in FIG. 24, the tabs 1215 are folded outwardly along the fold lines 1221 to form inner tabs 1223. These inner tabs 1223 are shaped to be inserted into the openings 1209 (and 1211) to engage the back (long) edge of the openings. The tabs 1215 are then folded downwardly and the tab extension 1217 is folded downwardly to be inserted into the openings 1209 (and 1211) so that the extension 1217 extends along the inner surface of the panels 1207A (and 1207C,D). As can be appreciated, there are three openings 1209 and three tabs 1215. The outer two openings overlie the openings 1211 of the dust panels. Thus the outer tabs 1215 engage not only the panel 1207A, but also the respective panels 1207C,D. The center tab 1215 engages only the panel 1207A. This interengagement of the panels securely locks the bottom of the panel closed. The interengagement of the panels is sufficiently strong to support six liquid filled bottles without the use of glue.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense.

We claim:

1. A beverage bottle carrier comprising a carrier box and a separate partition assembly which is secured in said box to divide the box into a plurality of bottle receiving cells;

the box having a front wall, a back wall, side walls, and a bottom; said bottom being made of a plurality of panels which depend from said walls, two of said panels being inner panels and two of said panels being outer panels; said inner and outer panels being secured to each other; said bottom outer panels being sized to meet at a joint without covering each other, said joint between said bottom outer panels being offset from a center of said carrier box bottom;

said partition assembly comprising at least one transverse partition having a length substantially equal to the distance between said carrier box side walls and at least one cross partition having a length substantially equal to the distance between said carrier box front and back walls, each of said partitions including:

glue tabs extending from side edges of said partitions, said glue tabs being adhered to inner surfaces of said carrier box to secure said partition assembly in said carrier box;

at least one slot extending from an edge of either of partitions;

a tab extending into said slot part way up said slot, said tab having a generally flat edge parallel to the edge from which said slot extends and facing away from an opening into said slot; and tab receiving slot spaced above each of said at least one slots;

said partition assembly being formed by sliding the slot of the one partition in to the slot of the other partition and then rotating the transverse and cross partitions relative to each other so that the tab of the transverse partition is received in the tab receiving slot of the cross partition and so that the tab of the cross partition is received in the tab receiving slot of the transverse partition, said transverse and cross partitions co-acting with each other to be locked together, the partition assembly being constructed without the use of glue.

2. The carrier of claim 1 wherein one of said bottom outer panels has a cutout and another of said bottom outer panels has a tab, said cutout out and tab being shaped complementary to each other, said juncture between said bottom outer panels being nonlinear.

3. The carrier of claim 2 wherein said front and back walls have substantially linear upper edges and said side walls have peaked upper edges, said side walls edges having a peak substantially in the center thereof.

4. The carrier of claim 3 wherein one of said at least one transverse partitions is a center transverse partition which extends between said side walls at the center of the side walls, said center transverse partition having a height greater than the height of said carrier box walls, said portion of said center transverse partition which extends above said carrier box walls defining a handle section and having an opening therethrough sized to receive the fingers of a user's hand.

5. The carrier of claim 4 wherein said carrier box is formed from a single blank, said blank including wall panels corresponding to said carrier walls; bottom panels used to form the carrier bottom; and a handle panel, said handle panel being separate from said wall and bottom panels by a tear line to be removable from said blank; said handle panel being sized to fit over said handle section of said center transverse partition.

* * * * *